United States Patent [19]

Tada

[11] Patent Number: 4,634,265

[45] Date of Patent: Jan. 6, 1987

[54] AUTOMATIC DOCUMENT FEED TYPE ELECTROPHOTOGRAPHIC COPYING MACHINE

[75] Inventor: Mitsuro Tada, Nara, Japan

[73] Assignee: Sharp Kabushiki Kaisha, Osaka, Japan

[21] Appl. No.: 679,382

[22] Filed: Dec. 7, 1984

[30] Foreign Application Priority Data

Dec. 9, 1983 [JP] Japan ..... 58-233261

[51] Int. Cl.[4] ..... G03G 15/00

[52] U.S. Cl. ..... 355/3 SH; 355/14 SH; 271/3.1

[58] Field of Search ..... 355/14 SH, 3 SH, 14 R; 271/3.1, 4, 9, 64, 258, 291

[56] References Cited

U.S. PATENT DOCUMENTS 4,412,740 11/1983 Buddendeck et al. ..... 355/14 SH 4,426,150 1/1984 Matsumoto et al. ..... 355/14 SH

*Primary Examiner*—A. C. Prescott

*Attorney, Agent, or Firm*—Birch, Stewart, Kolasch & Birch

[57] ABSTRACT

An electrophotographic copying machine comprises a document intake/return member for taking in each one of the document papers to the copying machine to conduct a copy operation, a document transport member for transporting a single document paper between the document intake/return member and a light scanning portion to provide an electrostatic latent image, a document exhaust member for exhausting the single document paper on an outside tray after being copied, and a mode selector for selecting the document transport member to forward the single document paper from the light scanning portion to the document exhaust member or return the same from the light scanning portion to the document intake/return member.

9 Claims, 2 Drawing Figures

AUTOMATIC DOCUMENT FEED TYPE ELECTROPHOTOGRAPHIC COPYING MACHINE

BACKGROUND OF THE INVENTION

The present invention relates to an electrophotographic copying machine and, more particularly, to an automatic document feed type electrophotographic copying machine.

An electrophotographic copying machine of an automatic document type has been presented. Some sorting machine must be provided for accomplishing both a simple sort function of simply sorting each set of copied papers and a group sort function of making and sorting each plurality of like copies for each original paper. However, since the sorting machine is rather expensive, it is desired to provide such a machine for providing both the simple sort function and the group sort function without any specific sorting machine.

SUMMARY OF THE INVENTION

Accordingly, it is an object of the present invention to provide an improved automatic document feed system for an electrophotographic copying machine for enabling a simple sort function and a group sort function without any specific sorter device.

It is another object of the present invention to provide an improved electrophotographic copying machine for enabling a simple sort function of simply sorting each set of copied papers and a group sort function of copying and sorting each plurality of like copies for each original paper, without any specific sorting machine.

It is a further object of the present invention to provide an improved electrophotographic copying machine comprising means for selectively forwarding document papers away from a document tray and returning them toward the same.

Briefly described, in accordance with the present invention, an electrophotographic copying machine comprises an automatic document feed system comprising a document intake/return means for taking in each one of some document papers to the copying machine to conduct a copy operation and returning the same, document transport means responsive to the document intake/return means for transporting a single document paper between the document intake/return means and a light scanning portion to produce an electrostatic latent image, document exhaust means responsive to the document transport means for exhausting the single document paper on a tray after being copied, and mode selecting means for selecting the document transport means to return the single document paper from the light scanning portion to the document intake/return means or forward the same from the light scanning portion to the document exhaust means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
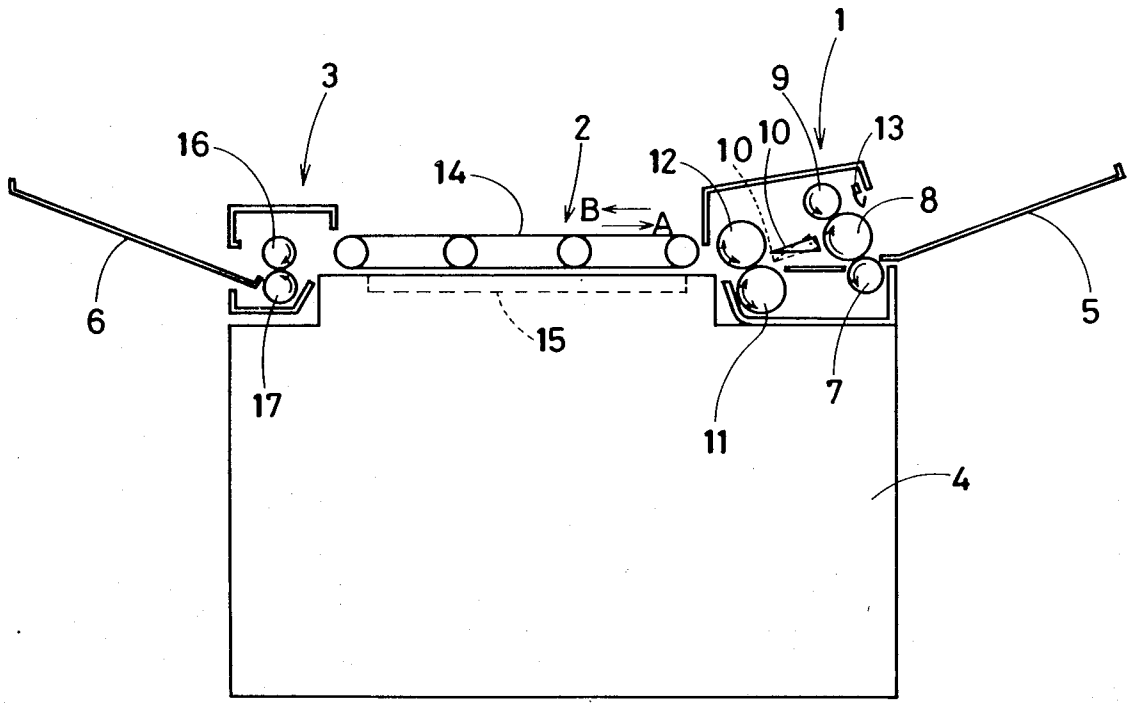
FIG. 1 is a sectional view of an electrophotographic copying machine according to the present invention.

FIG. 1 is a sectional view of an electrophotographic copying machine according to the present invention.

The copying machine comprises a document feed unit 1, a transport unit 2, an exhaust unit 3. All the units are positioned at the upper portions of the copying machine and can be detached independently.

At the inlet of the document feed unit 1, a document tray 5 is projected outside the body 4 of the machine. Although specifically not shown, the machine body 4 accommodates a number of necessary copying elements such as a photoreceptor, a developing member, a transference member, a fixing member, and a copied paper exhaust tray. A feeding roller 7 and a pick-up roller 8 connected to the lower portion of the document tray 5 are provided for subsequently grasping and picking up each one of some document pages, starting with and repeating with its lowest page, on the document tray 5. The roller 7 serves to feed the document pages while the roller 8 serves to pick up a single document page. The roller 8 is made of a material having a larger coefficient of friction than that of the document paper, so that it is prevented from grasping two or more document pages. At the upper part of the roller 8, a document return roller 9 is provided for exhausting in combination with the roller 8 the document paper returned from the transport unit 2 toward the document tray 5 as will be described later.

At the outlet of the document feed unit 1, a pair of rollers 11 and 12 are provided for sending the document paper from the document tray 5 into the transport unit 2. Alternatively, when they are rotated in the reverse direction, they serve to take in the document returned from the transport unit 2. A movable flapper 10 is provided among the rollers 7, 8, 9, 11, and 12 for selevtively changing the document paper transport direction. To direct the document paper forward toward the transport unit 2, the flapper 10 is directed in the forward direction as denoted by the solid line of FIG. 1 so that the document paper is transported from the document tray 5 to the transport unit 2 by the rollers 7, 8, 11, and 12. When the document paper is returned toward the document tray 5, the flapper 10 is directed in the backward direction as denoted by the broken line of FIG. 1 so that the document paper is transported from the transport unit 2 to the document tray 5 by the rollers 8, 9, 11, and 12. A document return sensor 13 is provided at the outlet of the roller 9 for sensing whether the document paper is returned, said document paper being adapted to the sensor 13. When the document paper is in contact with the sensor 13 while being transported by the rollers 8 and 9, the sensor 13 is switched on. When the paper completely traverses the rollers 8 and 9 whereby the paper is nolonger in contact with the sensor 13, it is switched off. The sensor 13 serves to monitor the return of the paper by being switched on and off. In synchronization with the off timing of the sensor 13, the flapper 10 is directed from the backward direction to the forward direction while all the driving systems are switched from the document backward direction to the document forward direction.

The transport unit 2 comprises a transport belt 14 transporting the document paper along a glass table of a transparent document table 15 of the copying machine body 4 between the units 1 and 3. The belt 14 is extended by some rollers between the units 1 and 3. The transport unit 2 including the belt 14, and the rollers are pivotally moved around and by the rear side of the cabinet of the copying machine body 4. When it is unnecessary to transport the document paper as is the case with a book, the transport unit 2 should be lifted to open the document table 15 so as to directly place the book on the table 15. While the transport unit 2 is mounted on the table 15, a belt face of the transport belt 14 is opposed to the table 15. When the document paper is traversed along the table 15 toward a light scanning position, the belt 14 is driven as denoted by arrow "A". Light is caused to scan the document paper to produce its corresponding electrostatic latent image on the photoreceptor. When the document paper is exhausted toward the exhaust unit 3, the belt 14 is driven in the same direction of the arrow "A". To cause the document paper to travel toward the document tray 5, The belt 14 is driven in reverse as denoted by arrow "B" to return the document paper.

The exhaust unit 3 includes a pair of rollers 16 and 17 facing each other. They serve to exhaust the forward document paper toward an exhaust tray 6.

With the above-mentioned automatic document feed system, the document papers are automatically transported to the document table 15. The document pages on the document tray 5 are subsequently copied and simply sorted as in the simple sort function of sorting each set of copied papers, as well as the control of the group sort function wherein a plurality of like copies of each single document page are produced. To select the simple sort, a first switch , e.g., a Recirculating Document Handler (RDH) switch on the body 4 of the copying machine is actuated. To select the group sort function, a second switch, e.g., an Automatic Document Feeder (ADF) switch on the body 4 is actuated. According to the mode selected by the "ADH" or "RDH" switch, the copying machine performs the automatic document feed control using a microcomputer. It should be noted that the "ADF" and "RDH" switches may be specific mode switches at least but the names "ADF" and "RDH" of the specific mode switches are not at the crux of the present invention.

The transport belt 14 and the rollers are driven with the same driving system. Possibly, they may be controlled by any discrete system or by any common driving system of the copy machine.

Figure 2:
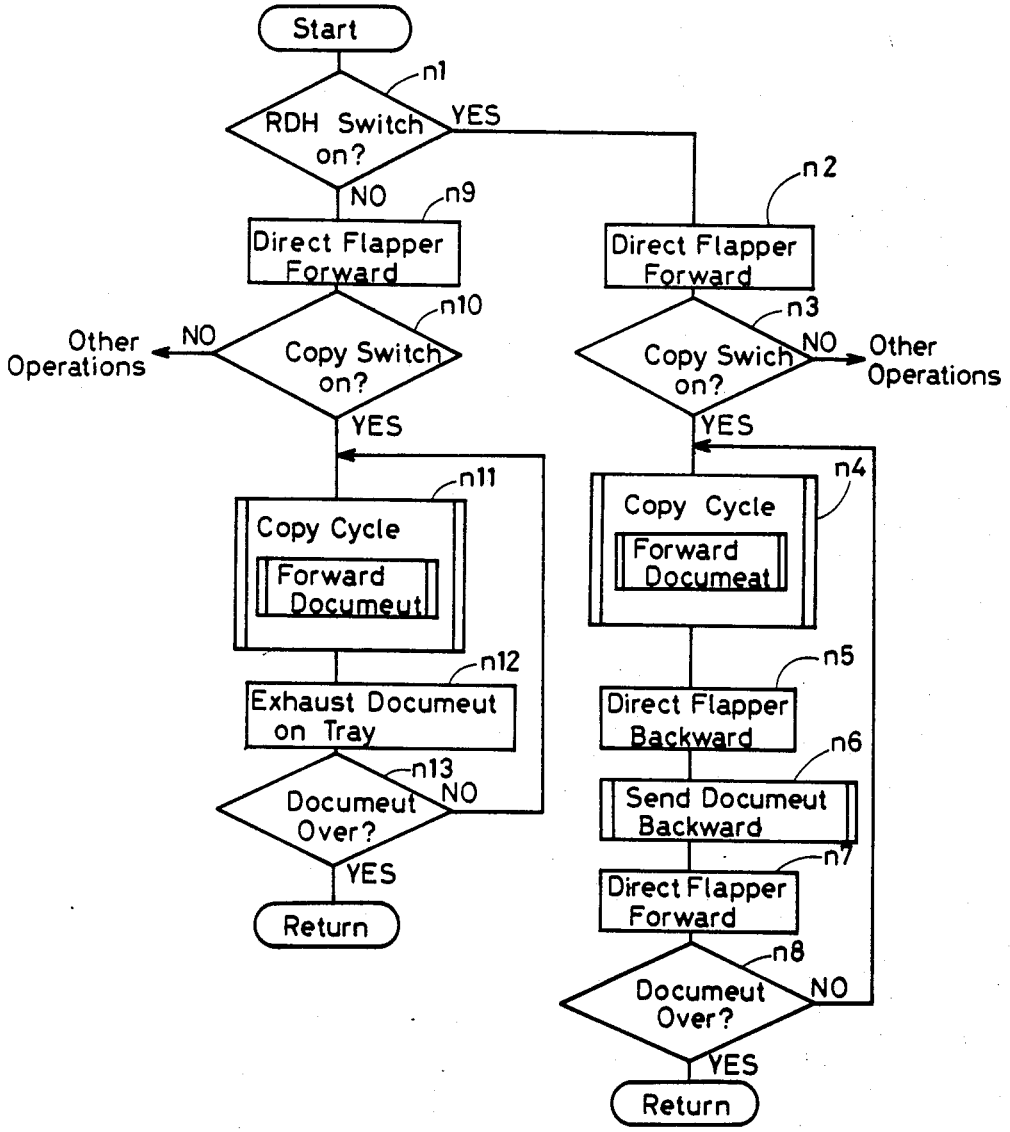
FIG. 2 is a flow chart of the operation of the copying machine of the present invention.

FIG. 2 is a flow chart of the operation of the copying machine.

(I) Simple Sort Mode:

Step n1: It is detected whether the "RDH" switch is actuated or not. To select the simple sort mode, in step n1, the document having some pages is disposed on the document tray 5 and then the numbers of the document pages and the necessary copies are inputted. The "RDH" switch is switched on to enable the simple sort mode.

Steps n2–n7: When the "RDH" switch is operated, the copying operation for the simple sort mode is selected and carried out.

Step n2: The set of the simple sort mode enables the flapper 10 to be directed in the foreward direction.

Steps n3 and n4: In response to the actuation of a copy start switch, a first copying cycle is started. According to the start of the first copying cycle, the lowest page of the document pages on the document tray 5 is extracted by the rollers 7 and 8. The extracted paper is traveled under the flapper 10 and transported into the transport unit 2 by the rollers 11 and 12. The paper is transported by the unit 2 toward the light scanning position of the document table 15 according to the movement of the belt 14 in the direction of the arrow "A" to thereby produce the corresponding electrostatic latent image. Thus, the document paper travels in the forward direction from the document tray 5 to the light scanning position. A single copied paper is exhausted on the copied paper exhaust tray.

Step n5: When the first copying cycle in step n4 has been terminated, the flapper 10 is directed backward in step n5. It is moved from the position as denoted by the solid line of FIG. 1 to that of the broken line thereof to the extent that the document paper can be returned to the document tray 5 by the return roller 9 and the roller 8.

Step n6: After the flapper 10 has been directed backward, the transport belt 14 is moved in the direction of the arrow "B" so as to start the backward movement of the document paper wherein the backward paper is taken into by the rollers 11 and 12. The rollers 11 and 12 are then rotated in a reverse direction to its original direction of rotation. The document paper from transport unit 2 is conveyed along the upper side of the flapper 10. The paper is finally returned by the rollers 8 and 9. Thus, the first page of the document is returned in step n6.

Step n7: After the first page is returned at step n6 and the document return sensor 13 detects its return and, the flapper 10 is moved forward again to receive the second page from the document tray 5.

Step n8: The above operations are thus repeated for forwarding and returning each document page to repeat the copying cycle until all the document papers, by the prescribed copy number and serially overlay on the copied paper exhaust tray have been copied.

Each document paper is returned by the or return movement to the remaining document pages on the document tray 5 each time it has been copied. The serial numbers and the four-side directions of the return document pages are unchanged on the remaining document papers. Therefore, after the first copying cycles to make a single set of copies have been terminated, a second and subsequent copying cycles are started in which case the document pages are subsequently forwarded and returned to complete the set copy numbers. Thus, the document papers are subsequently copied by repeating a single set of copies, so that a plurality of sets of the document papers can be automatically copied and subsequently sorted on the copied paper exhaust tray in the manner that each single set of copied papers are serially overlayed, but all the sets of copied papers are stacked in line one after another.

(II) Group Sort Mode:

Step n1: The document paper number and the copy number are inputted. The "ADF" switch is switched on.

Steps n9–n13: When it is detected that the "RDH switch is not operated and the "ADF" switch is switched on, the copying operation for the group sort mode is swlected and carried out.

Step n9: Since the group sort mode is characterized in that the document pages are not to be returned to the document tray 5, the flapper 10 is left in its farward direction.

Step n11: In response to the copy start switch, the lowest document page is first extracted from the document pages on the document tray 5 and transported to the light scanning position of the transport unit 2 to conduct the copying operation cycle in the same manner as step n4. In Step n11, everyone of the document pages transported by the transport unit 2 is multi-copied by the input copy number. A plurality of like copied papers of each document paper are thus produced. The like copied papers are exhausted on the copied paper exhaust tray.

Step n12: After the copy cycle of step n11, the transport belt 14 is moved in the arrow "A" direction so that the scanned document paper is exhausted on the tray 6.

Thus, each document paper is moved on the transport unit 2 to make multiple copies. Each time the single copying operation has been terminated, the document paper is exhausted on the tray 6. These copying operations are repeated in steps n11, n12, and n13. The group sort mode is characterized in that each of the document pages is plurally copied by the input copy set number. A plurality of groups of like copied papers are subsequently exhausted on the copied paper exhaust tray in line one after another.

To enable the single set of copies, a single set copying operation is conducted in step n11.

As described above, in accordance with the present invention, the automatic document feed system can achieve the simple sort function and the group sort function without any specific sorting machine. Because the direction of exhausting the document papers can be selected according to the sort mode, the simple sort mode and the group sort mode are both possible. The three discrete units can be separated, thereby being compact. The transport unit 2 can be operated also as a document paper cover means. The present automatic document feed system can be applied to general-purpose copying machines.

While only certain embodiments of the present invention have been described, it will be apparent to those skilled in the art that various changes and modifications may be made therein without departing from the sprit and scope of the present invention as claimed.

What is claimed is:

1. An automatic document feed system for an electrophotographic copying machine comprising:

a document intake/return means for sequentially introducing document papers to the copying machine to be copied and returning the document papers which have been copied;

document transport means operable to rotate in a forward and reverse direction, said document transport means being responsive to said document intake/return means for transporting a single document paper between both said document intake/return means and a light scanning portion of the copying machine to produce an electrostatic latent image;

document exhaust means responsive to said document transport means for removing a single document paper which has been copied from the document transport means, and mode selecting means operatively associated with said document transport means for selecting said document transport means to either forward the single document paper from said light scanning portion to said document exhaust means or return said document paper from said light scanning portion to said document intake/return means.

2. The apparatus of claim 1, wherein said document intake/return means comprises a movable flapper for selectively guiding the single document paper from said document intake means to said document transport means and from said document transport means to said document return means.

3. The apparatus of claim 1, wherein said document transport means comprises a belt extending over the area between said document intake/return means and said document exhaust means.

4. The apparatus of claim 1, wherein said mode selecting means includes first and second manual switches.

5. The apparatus of claim 1, wherein said document intake/return means comprises at least three rollers which are operable to rotate in a forward and reverse direction according to the modes selected by said mode selecting means.

6. The apparatus of claim 1, wherein said document intake/return means comprises document return sensor means for detecting the return of the document paper to said return means.

7. The apparatus of claim 1, wherein a feed tray is provided adjacent the document intake/return means for receiving the document paper.

8. The apparatus of claim 1, wherein an exhaust tray is provided adjacent the document exhaust means for receiving the document paper.

9. The apparatus of claim 1, wherein the document intake/return means includes, on the inlet side thereof, a feed roller, pick-up roller and return roller in stacked relationship and on the outlet side thereof a pair of opposite rollers with a moveable flapper disposed therebetween and sensor means disposed on the inlet side of said return roller for rotating said movable flapper when contacted by the document paper returning to the document return means.

* * * * *